US006691314B1

(12) United States Patent
Grilliot et al.

(10) Patent No.: US 6,691,314 B1
(45) Date of Patent: Feb. 17, 2004

(54) FACE MASK, HEAD HARNESS, AND PROTECTIVE HOOD FOR FIREFIGHTER

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 4 days.

(21) Appl. No.: 10/265,863

(22) Filed: Oct. 7, 2002

(51) Int. Cl.[7] ..... A42B 3/00

(52) U.S. Cl. ..... 2/5; 2/9; 2/173; 2/202; 2/427; 128/201.25; 128/201.29; 128/207.11

(58) Field of Search ..... 2/202, 205, 424, 2/517, 819, 427, 428, 81, 173, 452; 128/201.29, 201.25, 201.22, 201.23, 201.24, 206.24, 206.28, 205.25, 207.11, 207.17, 206.21

(56) References Cited

U.S. PATENT DOCUMENTS

| | | | | | |
|---|---|---|---|---|---|
| 1,939,188 | A | * | 12/1933 | Schleich | 128/201.23 |
| 2,353,643 | A | * | 7/1944 | Bulbulian | 128/207.11 |
| 3,624,663 | A | * | 11/1971 | Jones | 2/424 |
| 4,573,217 | A | | 3/1986 | Reed | |
| 4,972,520 | A | | 11/1990 | Grilliot et al. | |
| 5,038,776 | A | * | 8/1991 | Harrison et al. | 128/207.11 |
| 5,069,205 | A | * | 12/1991 | Urso | 128/201.24 |
| 5,191,882 | A | * | 3/1993 | Vogliano | 128/207.11 |
| 5,309,571 | A | * | 5/1994 | Huang | 2/458 |
| 5,431,156 | A | * | 7/1995 | Sundstrom | 128/201.23 |
| 6,006,360 | A | | 12/1999 | Reed | |
| 6,266,828 | B1 | | 7/2001 | Corsini | |
| 6,328,031 | B1 | | 12/2001 | Tischer et al. | |
| 6,478,025 | B1 | | 11/2002 | Yort et al. | |
| 6,578,572 | B2 | | 6/2003 | Tischer et al. | |

* cited by examiner

*Primary Examiner*—Rodney M. Lindsey
(74) *Attorney, Agent, or Firm*—Wood, Phillips, Katz, Clark & Mortimer

(57) ABSTRACT

For a firefighter, a combination of protective gear comprises a face mask, a head harness, and a protective hood adapted to cover the wearer's head, except for at least a portion of the wearer's face, and to cover an outer perimeter of a window portion of the face mask. The protective hood is attached to the head harness, preferably to flexible straps of the head harness, so that the protective hood is attachable to the face mask, along with the head harness, and so the protective hood is detachable from the window portion, along with the head harness. The protective hood is attached thereto via stitches or is attached thereto detachably, as via snap fasteners or hook-and-loop fasteners.

20 Claims, 2 Drawing Sheets

FACE MASK, HEAD HARNESS, AND PROTECTIVE HOOD FOR FIREFIGHTER

TECHNICAL FIELD OF THE INVENTION

This invention pertains to protective gear for a firefighter, particularly a face mask, such as a face mask for a self-contained breathing apparatus, a head harness attached detachably to the face mask and used for securing the face mask removably to the wearer's head, and a protective hood, in a novel combination.

BACKGROUND OF THE INVENTION

Commonly, a firefighter is required to wear a face mask, such as a face mask for a self-contained breathing apparatus, as secured removably to the wearer's head, via a head harness, which is attached detachably to the face mask, via fasteners at or near an outer perimeter of the face mask. Along with the face mask, the firefighter may be also required to wear a protective hood, which provides a fire-retardant, thermally insulative barrier protecting the wearer's head, except for at least a portion of the wearer's face where the face mask is worn, and protecting the wearer's neck, and which is worn so as to cover at least part of an outer perimeter of a window portion of the face mask. As exemplified in U.S. Pat. No. 6,266,828 and in U.S. Pat. No. 6,328,031, it is known for the protective hood to be directly and detachably attached to the face mask, as via similar fasteners used to attach the head harness detachably to the face mask.

SUMMARY OF THE INVENTION

This invention provides, for a firefighter, a protective combination comprising a face mask, a head harness, and a protective hood. The head harness, which is attached detachably to the face mask, is adapted to secure the face mask removably to the wearer's head so that the face mask is disposed in a frontal position relative to the wearer's face. The protective hood is adapted, when worn with the face mask, to cover the wearer's head, except for at least a portion of the wearer's face, and to cover an outer perimeter of the face mask. This invention contemplates that the protective hood is attached to the head harness, rather than directly to the face mask, so that the protective hood is attachable to the window portion, along with the head harness, and so the protective hood is detachable from the window portion, along with the head harness. The protective hood is attached to the head harness non-detachably, as via stitches, or is attached to the head harness detachably, as via snap fasteners or hook-and-loop fasteners. If the head harness has flexible straps, which are known in a head harness, the protective hood may be thus attached to those straps.

BRIEF DESCRIPTION OF THE DRAWINGS

FIG. 5 illustrates a snap fastener. FIG. 6 illustrates a hook-and-loop fastener.

DETAILED DESCRIPTION OF THE ILLUSTRATED EMBODIMENTS

Figure 1:
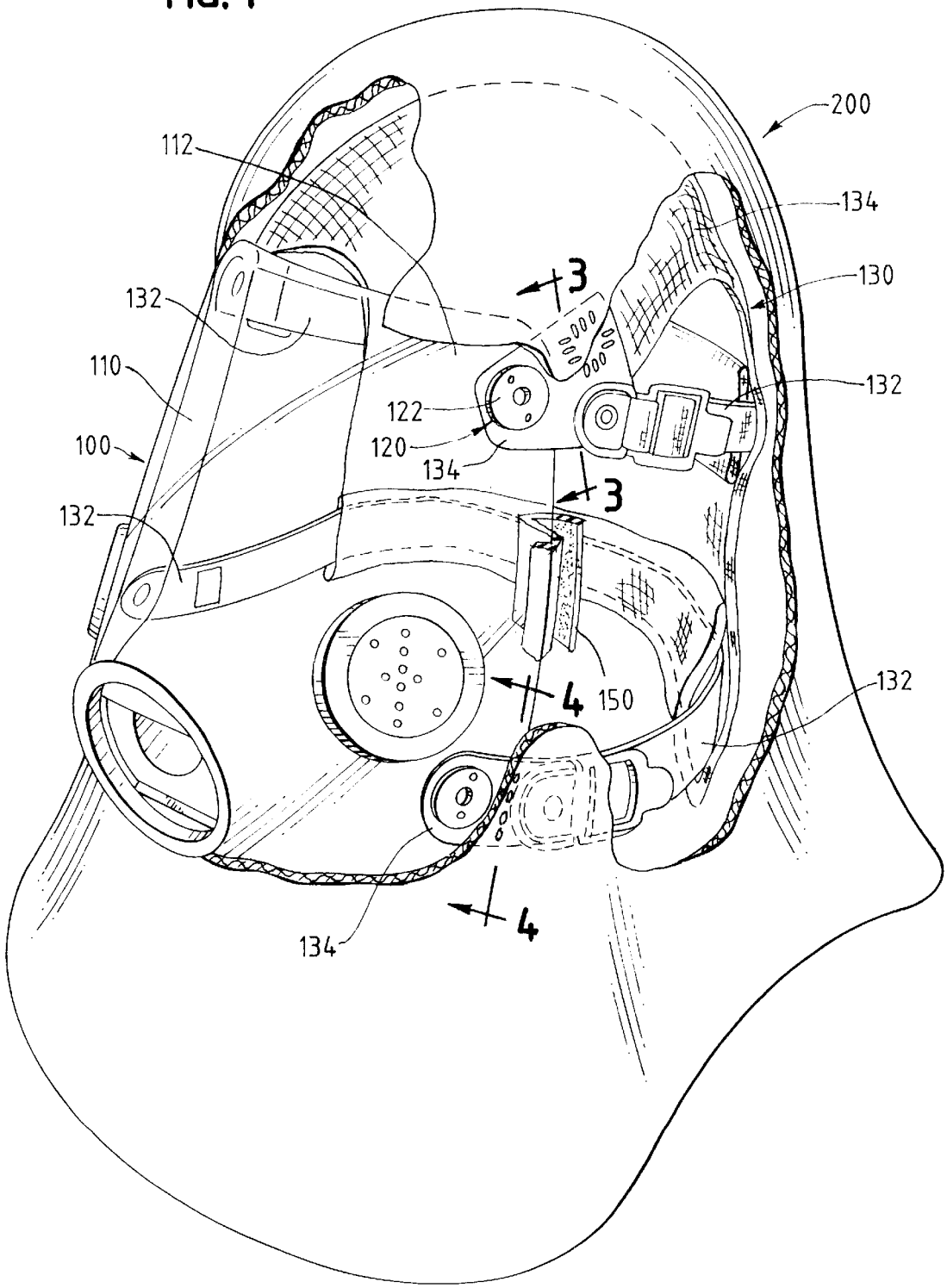
FIG. 1 is a perspective view of a face mask, a head harness, and a protective hood, in a novel combination embodying this invention, the face mask being a face mask for a self-contained breathing apparatus. The face mask, the head harness, and the protective hood are disposed in FIG. 1 as they would be disposed if they were being worn by a firefighter.
Figure 2:
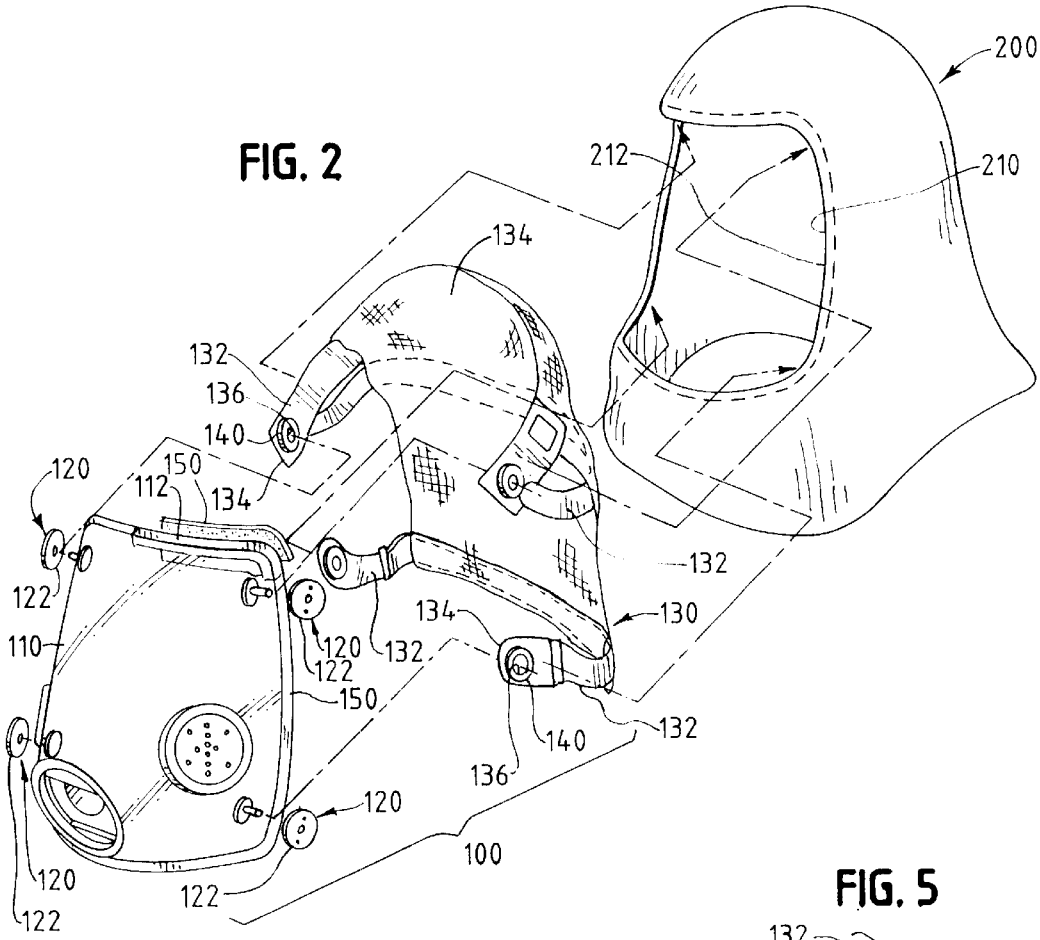
FIG. 2, on a smaller scale compared to FIG. 1, is an exploded perspective view of the novel combination.

As illustrated in FIGS. 1 and 2, a combination intended to be worn by a firefighters who is not illustrated, comprising a face mask 100 for a self-contained breathing apparatus (SCBA) and a head harness 130 attached detachably to the face mask 100 and used for securing the face mask 100 removably to the wearer's head, and further comprising a protective hood 200 constitutes a preferred embodiment of this invention. The head harness 130 is attached detachably to the face mask 100, in a known manner, and the protective hood 200 is attached non-detachably or detachably to the head harness 130, in a novel manner contemplated by this invention, so as to facilitate their being donned together and so as to facilitate their being cleaned after having been used. The protective hood 200 is not attached directly to the face mask 100.

The face mask 100, which is known, has a window portion 110, which is made from a suitable, transparent polymer, such as polycarbonate, so that the firefighter wearing the face mask 100 can see through the window portion 110. The face mask 100 has an outer perimeter 112, near which four threaded fasteners 120 having large outer heads 122 are mounted. The head harness 130, which is known except for the protective hood 200 being attached to the head harness 130, is attached detachably to the face mask 100, via the fasteners 120, and is adapted to secure the face mask 100 removably to the wearer's head so that the window portion 110 is disposed in a frontal position relative to the wearer's face. The head harness 130 has flexible fabric, natural or synthetic leather, or synthetic rubber straps 132, which are attached at their distal ends 134 to the face mask 100. The head harness 130 has a rear cap 134, which is made from a mesh of flexible strands and which is sewn to the straps 132. Near their distal ends 134, the straps 132 have holes 136, which are defined by grommets 140 mounted to the straps 132 and through which such threaded fasteners 120 pass, whereby to attach the head harness 130 detachably to the window portion 110. The face mask 100 has a resiliently conformable, synthetic rubber portion 150, which is attached to the window portion 110 and which contacts and conforms to the wearer's face when the face mask 100 is worn. Further particulars of these and other features of the face mask 100 and the head harness 130 are outside the scope of this invention and can be readily supplied by persons having ordinary skill in the art of protective gear for firefighters.

The protective hood 200, which is known except for the novel manner of its being attached the head harness 130, has plural layers providing a fire-retardant, thermally insulative barrier. The protective hood 200 is adapted, when worn with the face mask 100 and the head harness 130, to cover the wearer's head, except that the protective hood 200 has a front opening 210 allowing at least a portion of the wearer's face to remain uncovered by the protective hood 200, and to cover the outer perimeter 112 of the window portion 110 of the face mask 100, at a margin 212 of the front opening 210. Further particulars of these and other features of the protective hood 200 are outside the scope of this invention and can be readily supplied by persons having ordinary skill in the art of protective gear for firefighters.

Figure 5:
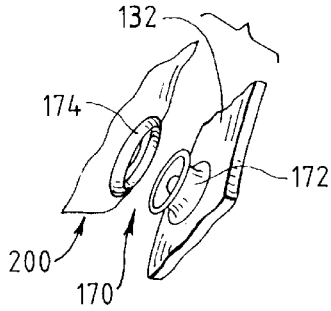
FIGS. 5 and 6, respectively, are fragmentary details illustrating alternative means to attach the protective hood to flexible straps of the head harness.
Figure 3:
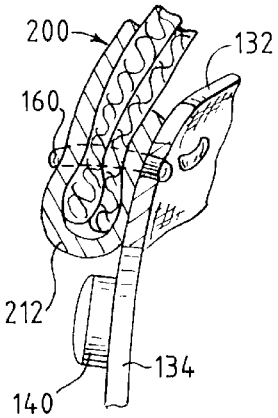
FIGS. 3 and 4, on a larger scale compared to FIG. 2, are sectional views taken along line 3—3 and line 4—4, respectively, in directions indicated by arrows, to illustrate the protective hood being attached to flexible straps of the head harness via stitches.
Figure 4:
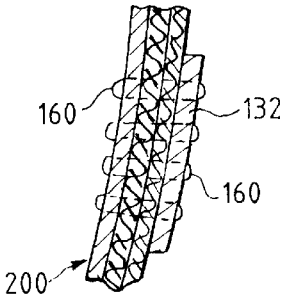
Figure 6:
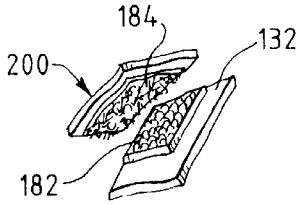

As contemplated by this invention, the protective hood 200 is attached to the head harness 130, not directly to the face mask 100. Preferably, as illustrated in FIGS. 1, 2, 3, and 4, the protective hood 200 is attached to each strap 132 via stitches 160, which are regarded as attaching the protective hood 200 non-detachably. Alternatively, as illustrated in FIG. 5, the protective hood 200 is attached detachably to each strap 132 via a snap fastener 170, which has a male element 172 attached to said strap 132 and a female element 174 attached to the protective hood 200. Alternatively, these elements 172, 174, are reversed so that the male element 172 is attached to the protective hood 200 and so that the female element 174 is attached to said strap 132. Alternatively, as illustrated in FIG. 6, the protective hood 200 is attached detachably to each strap 132 via a hook-and-loop fastener 180, which has a hook-faced element 182 attached to said strap 132 and a loop-faced element 184 attached to the protective hood. Alternatively, these elements 182, 184, are reversed so that the hook-faced element 182 is attached to the protective hood 200 and so that the loop-faced element 184 is attached to said strap 132. Rather than stitches, snap fasteners, and hook-and-loop fasteners, other similar or dissimilar means may prove suitable for attaching the protective hood 200 non-detachably or detachably to the head harness 130 and may be instead used.

Because the protective hood 200 is attached to the head harness 130, not directly to the face mask 100, the protective hood 200 can be easily detached from the face mask 100, along with the head harness 130, as for cleaning of the protective hood 200 and the head harness, together, in a suitable manner, after the combination of the face mask 100, the head harness 130, and the protective hood 200 has been used. The face mask 100, of which the window portion 120 and the synthetic rubber portion 150 remain attached to each other, can be separately cleaned in a different manner.

Although the combination provided by this invention is intended to be worn by a firefighter, such a combination may prove to be also useful if worn by other persons needing head protection, such as rescue workers or chemical workers dealing with chemical spills.

What is claimed is:

1. For a firefighter, rescue worker, or chemical worker or another wearer needing head protection, a combination comprising a face mask, a head harness, and a protective hood, wherein the face mask has an outer perimeter, wherein the head harness is attached detachably to the face mask and is adapted to secure the face mask removably to the wearer's head so that the face mask is disposed in a frontal position relative to the wearer's face, wherein the protective hood is adapted, when worn with the face mask, to cover the wearer's head and neck, except for at least a portion of the wearer's face, and to cover at least part of the outer perimeter of the face mask, and wherein the protective hood is attached to the head harness so that the protective hood and head harness, while attached to each other, are attachable to the face mask and are detachable from the face mask.

2. The combination of claim 1 wherein the protective hood is attached non-detachably to the head harness.

3. The combination of claim 1 wherein the protective hood is attached detachably to the head harness.

4. The combination of claim 1 wherein the protective hood is attached via stitches to the head harness.

5. The combination of claim 1 wherein the protective hood is attached via snap fasteners to the head harness.

6. The combination of claim 1 wherein the protective hood is attached via hook-and-loop fasteners to the head harness.

7. The combination of claim 1 wherein the head harness has flexible straps, to which the protective hood is attached.

8. The combination of claim 1 wherein the head harness has flexible straps, to which the protective hood is attached non-detachably.

9. The combination of claim 1 wherein the head harness has flexible straps, to which the protective hood is attached detachably.

10. The combination of claim 1 wherein the head harness has flexible straps, to which the protective hood is attached via stitches.

11. The combination of claim 1 wherein the head harness has flexible straps, to which the protective hood is attached via snap fasteners.

12. The combination of claim 1 wherein the head harness has flexible straps, to which the protective hood is attached via hook-and-loop fasteners.

13. For a firefighter, a combination comprising a face mask, a head harness, and a protective hood, wherein the face mask has an outer perimeter, wherein the head harness is attached detachably to the face mask and is adapted to secure the face mask removably to the wearer's head so that the face mask is disposed in a frontal position relative to the wearer's face, wherein the protective hood is adapted, when worn with the face mask, to cover the wearer's head and neck, except for at least a portion of the wearer's face, and to cover at least part of the outer perimeter of the face mask, and wherein the combination further comprises means for attaching the protective hood non-detachably to the head harness so that the protective hood is attachable to the face mask, along with the head harness, and so the protective hood is detachable from the face mask, along with the head harness.

14. The combination of claim 13 wherein the attaching means comprises stitches.

15. For a firefighter, a combination comprising a face mask, a head harness, and a protective hood, wherein the face mask has an outer perimeter, wherein the head harness is attached detachably to the face mask and is adapted to secure the face mask removably to the wearer's head so that the face mask is disposed in a frontal position relative to the wearer's face, wherein the protective hood is, adapted, when worn with the face mask, to cover the wearer's head and neck, except for at least a portion of the wearer's face, and to cover at least part of the outer perimeter of the face mask, and wherein the combination further comprises means for attaching the protective hood detachably to the head harness so that the protective hood is attachable to the face mask, along with the head harness, and so the protective hood is detachable from the face mask, along with the head harness.

16. The combination of claim 15 wherein the attaching means comprises a snap fastener.

17. The combination of claim 15 wherein the attaching means comprises a hook-and-loop fastener.

18. The combination of claim 15 wherein the head harness has flexible straps, to which the protective hood is attached via the attaching means.

19. The combination of claim 15 wherein the head harness has flexible straps, to which the protective hood is attached via the attaching means, which comprises a snap fastener.

20. The combination of claim 15 wherein the head harness has flexible straps, to which the protective hood is attached via the attaching means, which comprises a hook-and-loop fastener.

* * * * *